United States Patent [19]

Young

[11] 3,946,401

[45] Mar. 23, 1976

[54] ELECTROTHERMOGRAPHIC IMAGE PRODUCING TECHNIQUES

[75] Inventor: Eugene F. Young, Henrietta, N.Y.

[73] Assignee: Xerox Corporation, Stamford, Conn.

[22] Filed: May 6, 1974

[21] Appl. No.: 467,164

Related U.S. Application Data

[62] Division of Ser. No. 332,684, Feb. 15, 1973, abandoned.

[52] U.S. Cl. ..... 346/74 ES; 96/1 R; 101/DIG. 13; 346/74 R

[51] Int. Cl. ..... G03g 15/052

[58] Field of Search ..... 96/1 R, 1.5, 27 R; 346/74 ES, 74 EP, 74 EE, 74 R; 101/DIG. 13; 60/59

[56] References Cited

UNITED STATES PATENTS

| | | | |
|---|---|---|---|
| 3,222,519 | 12/1965 | McNaney | 346/74 P |
| 3,245,785 | 4/1966 | Miller | 346/74 P |
| 3,634,867 | 1/1972 | McConnell | 346/74 P |
| 3,659,936 | 5/1972 | Klose | 346/74 ES |

FOREIGN PATENTS OR APPLICATIONS

| | | | |
|---|---|---|---|
| 1,009,379 | 11/1965 | United Kingdom | 96/1.5 |

OTHER PUBLICATIONS

"A Bistable Resistor," – Bongers and Enz, Philips Res. Repts. 21, pp. 387–389, 1966.

*Primary Examiner*—Bernard Konick
*Assistant Examiner*—Jay P. Lucas

[57] ABSTRACT

A method of producing viewable images is disclosed wherein a layer of electrostatic charge is deposited on the surface of a 3d metal oxide that is disposed in an ambient temperature below the Neel temperature. The temperature at certain portions of the surface of the 3d metal oxide is increased to exceed the Neel temperature such that the 3d metal oxide undergoes an insulator-to-metal transition whereby the layer of electrostatic charge is selectively dissipated to form an electrostatic latent image corresponding to those portions of the surface that are subjected to an increase in temperature. The electrostatic latent image is then developed to form a viewable image. In one embodiment of the present invention the temperature is increased to exceed the Neel temperature by imaging a character pattern comprised of modulated radiant energy onto the surface of the 3d metal oxide. In another embodiment of this invention the temperature is increased to exceed the Neel temperature by transferring thermal energy forming a character pattern to the surface of the 3d metal oxide. In a further embodiment of this invention the electrostatic latent image is formed by depositing an electrostatic charge on the surface of the 3d metal oxide, the latter having certain portions thereof at a temperature that exceeds the Neel temperature therefor.

13 Claims, 6 Drawing Figures

ELECTROTHERMOGRAPHIC IMAGE PRODUCING TECHNIQUES

Figure 1A:
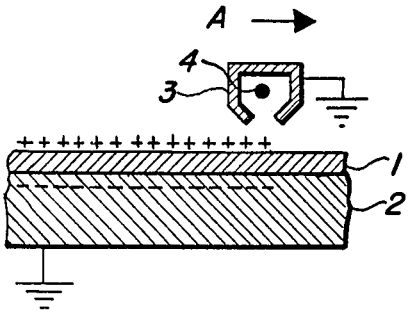

This is a division, of application Ser. No. 332,684, filed Feb. 15, 1973, now abandoned.

This invention relates to a method of producing viewable images and in particular, to a method of producing viewable images on a surface comprised of an oxide of a 3d transition element.

In the art of electrophotography, the techniques generally utilized to reproduce documents or other graphic material have long been known to those of ordinary skill. These techniques are fundamentally disclosed in U.S. Pat. No. 2,297,691 issued to Chester F. Carlson. Briefly, conventional electrophotographic reproducing techniques image modulated radiation onto a photoconductive plate to selectively dissipate a uniform layer of electrostatic charge that has been deposited on the surface of the plate to form an electrostatic latent image of an original document. The photoconductive plate is comprised of a thin layer of photoconductive material overlying a conductive substrate. The photoconductive layer exhibits good electrical insulating characteristics in the dark to retain the electrostatic charges on the surface thereof; and is photoresponsive to impinging radiation whereby the electrical resistance thereof is sufficiently reduced to permit rapid dissipation of the electrostatic charges. Typical examples of photoconductive material that have been successfully employed include zinc oxide, selenium, anthracene, sulfur, photoconductive phosphors and the like. The electrostatic latent image thus formed on the surface of the photoconductive material is developed by depositing electroscopic material thereon and the developed image may then be transferred to a support surface to form a final copy of the original document.

The present invention utilizes techniques analogous to those heretofore utilized in the electrostatic production of images in conjunction with material that is not photoconductive to produce viewable images.

It has been discovered that for an antiferromagnetic material the magnetic susceptibility thereof exhibits a discontinuous transition at a critical temperature known as the Neel temperature. Further investigation has revealed that various oxides undergo a reversible metal-to-insulator transition at the Neel temperature. oxides of titanium and vanadium exhibit the low conductivity characteristics of an insulator below the Neel temperature thereof while the high conductivity characteristics of a metal are exhibited above the Neel temperature. These transitions, which have been described by F. J. Morin in the paper entitled "Oxides Which Show a Metal-To-Insulator Transition At the Neel Temperature, " Physical Review Letters, Volume 3, Number 1, pages 34–36, Jul. 1, 1959, are characterized by thermal hysteresis. In Adler: "Mechanisms for Metal-Nonmetal Transitions in Transition Metal Oxides and Sulfides, " Review of Modern Physics, Volume 40, Number 4, pages 714–734, October, 1968, it is described that insulator to metal transitions (also known as semiconductor to metal transitions) have been observed in various oxides and sulfides of titanium, vanadium, chromium, manganese, iron, cobalt, nickel and copper. Those of ordinary skill in the art clearly recognize that these metals comprise the 3d transition metals. A theoretical explanation for such transitions is set forth in detail in the last-mentioned paper. The Neel temperatures for the 3d transition metal oxides and sulfides described by Adler are set forth in the following table:

Table I

| Oxide/Sulfide | Transition Temperature (degrees K) |
|---|---|
| $V_2O_3$ | 150°K |
| $VO_2$ | 340°K |
| VO | 126°K |
| $V_6O_{13}$ | 149°K |
| $Ti_2O_3$ | 450°K |
| $Nb\ O_2$ | 1070°K |
| $Fe_3O_4$ | 119°K |
| NiS | 264°K |
| CrS | 600°K |

Of the foregoing elements, the semiconductor-to-metal transition of the oxides of vanadium have been most interesting. In particular, the transition temperature of $VO_2$ is equal to approximately 68°C. This temperature may be readily ascertained and controlled by relatively inexpensive thermal controlled devices. Thus, $VO_2$ has been adopted to form a bistable device as disclosed in "A Bistable Resistor on the Basis of Vanadium Oxide" by Bongers et al., Phillips Research Reports 21, pages 387–389, 1966. Furthermore, the occurrence of an insulator to metal transition has been investigated for Cr-doped $V_2O_3$, and is described by McWhan et al. in "Mott Transition in Cr-Doped $V_2O_3$", 23 Physical Review Letters, Number 24, Dec. 15, 1969, pages 1384–1387, and at pages 3734–3756 of 2 Physical Review B, Number 9, Nov. 1, 1970.

Although the properties of 3d transition metal oxides and sulfides have long been known, the prior art has been reticent in exploiting the insulator-to-metal transition characteristics thereof. The present invention provides a novel adaptation of such 3d transition metal oxides to achieve the production of viewable images by techniques not heretofore contemplated by the prior art.

Therefore, it is an object of the present invention to provide a method of producing viewable images.

It is another object of the present invention to utilize a 3d transition metal oxide in producing a viewable image.

A further object of this invention is to induce certain portions of a 3d transition metal oxide to undergo an insulator-to-metal transition thereby forming a latent image of a character pattern.

Yet another object of this invention is to provide a method of producing a viewable image wherein modulated radiant energy is employed to induce a 3d transition metal oxide to selectively undergo an insulator-to-metal transition in accordance with the modulations of said modulated radiant energy.

An additional object of this invention is to provide a method of recording a character pattern comprised of thermal energy.

It is a still further object of the present invention to provide a method of electrophotographically reproducing copies of prerecorded information wherein the temperature of certain portions of a 3d transition metal oxide having a layer of electrostatic charge deposited thereon is increased above the Neel temperature whereby said certain portions exhibit the electrical characteristics of an electrically conductive metal to selectively dissipate said layer of electrostatic charge to form an electrostatic latent image.

Various other objects and advantages of the invention will become clear from the following detailed description of exemplary embodiments thereof and the novel features will be particularly pointed out in connection with the appended claims.

In accordance with this invention, a method of producing viewable images is provided wherein a 3d transition metal oxide having a layer of electrostatic charge deposited thereon and disposed in an ambient temperature below the Neel temperature is exposed to modulated radiant energy whereby the radiant energy is converted into corresponding modulations of heat such that the temperature of certain portions of the 3d transition metal oxide is increased to exceed the Neel temperature, resulting in the selective dissipation of said layer of electrostatic charge; the remaining electrostatic charge forms an electrostatic latent image of the modulated radiant energy, which latent image is developed to form a viewable image; and the viewable image may be transferred to a support surface to form a viewable copy of the modulated radiant energy.

Figure 1B:
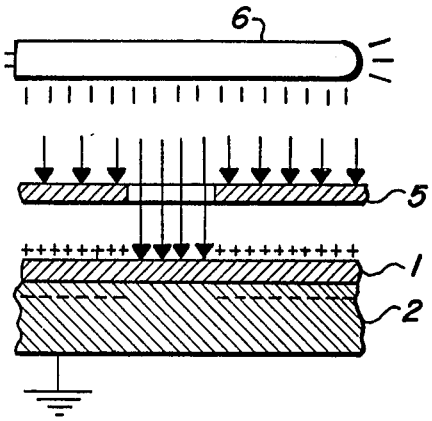
Figure 1C:
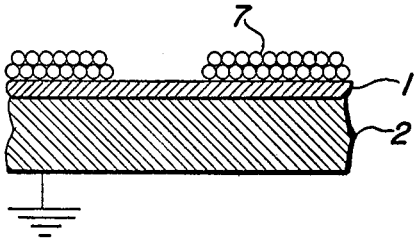
Figure 1D:
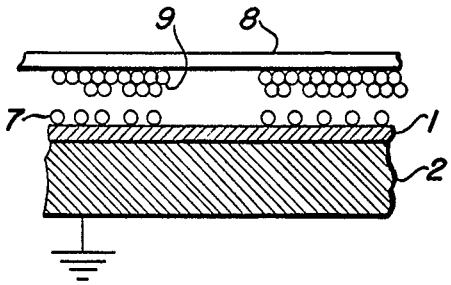
Figure 1E:
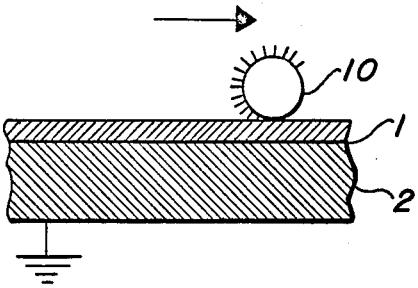
Figure 2:
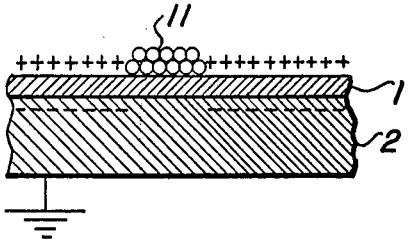

The invention will be more clearly understood by reference to the following detailed description of exemplary embodiments thereof in conjunction with the accompanying drawings in which:

FIGS. 1A-1E illustrate one embodiment of the present invention wherein a viewable image is produced on a 3d transition metal oxide; and FIG. 2 illustrates another embodiment of the present invention for developing an electrostatic latent image formed on the surface of a 3d transition metal oxide.

Referring now to the drawings, wherein like reference numerals are used throughout, and in particular to FIG. 1A, there is illustrated a layer of 3d transition metal oxide 1, substrate 2 and a corona discharge device 3. The 3d transition metal oxide 1 may be an oxide of a metal selected from the group consisting of titanium, vanadium, chromium, manganese, iron, cobalt, nickel and copper. Accordingly, the 3d transition metal oxide, commonly referred to by those of ordinary skill in the art as merely a 3d metal oxide, may include, but is not to be limited to, those oxides listed in Table I hereinabove. Alternatively, a 3d metal sulfide may comprise layer 1. For the purposes of explanation it will be assumed that layer 1 is comprised of VO2; however, it should readily be understood that the following description is equally applicable to other 3d metal oxides such as those described in the aforementioned references. The 3d metal oxide layer 1 comprises a thin film that is deposited upon a metallic substrate 2 by vacuum deposition or other techniques well known in the art. The film may be of a 3d metal oxide dispersed in a resin binder, the latter being a conventional binder normally used in the photoconductor art. It is appreciated that the 3d metal oxide will exhibit the high resistive characteristics of an insulator when disposed in an ambient temperature that is less than the insulator-to-metal transition temperature. Accordingly, for the assumed example wherein layer 1 is comprised of VO2, the ambient temperature is decreased below 68°C., which corresponds to the Neel temperature therefor. A layer of electrostatic charge is adapted to be deposited on the surface of layer 1. The electrostatic charge may be deposited by an alpha-emitting radioactive source for ionizing the air emitted by alpha particles; by a conductive rubber roller having a potential applied thereto wherein the roller is rolled over the surface of layer 1; by a charged insulator placed in contact with the layer 1 whereby charges may be transferred thereto from the insulator; or by a corona discharge device of the type described in U.S. Pat. No. 2,777,957 which issued to L. E. Walkup. In the exemplary embodiment illustrated in FIG. 1A, a corona discharge device 3 comprised of a corona discharge electrode 4 and a partially surrounding shield 3 is utilized to deposit a layer of electrostatic charge. If the corona discharge electrode 4 is supplied with a positive d.c. corona generating potential and the shield is supplied with a reference potential such as ground, positive charges indicated by + are deposited on layer 1. It is apparent that the corona discharge device 3 may be displaced in the direction indicated by the arrow A at a constant rate of speed to deposit a uniform layer of electrostatic charge over the entire surface of the layer of 3d metal oxide 1. Alternatively, the layer 1 may be displaced in a direction opposite to that indicated by the arrow A. Although positive electrostatic charges are illustrated in FIG. 1A, a layer of negative electrostatic charges may be deposited by supplying the corona discharge electrode 4 with a negative corona generating potential. The polarity of electrostatic charge deposited on layer 1 is not critical to the successful performance of the novel process disclosed herein. Since the 3d metal oxide layer 1 is disposed in an ambient temperature below the Neel temperature, the 3d metal oxide exhibits the electrical characteristics of an insulator. Consequently, layer 1 is highly resistive and the combination of the 3d metal oxide layer 1 and substrate 2 may be considered to be a simple capacitor in which the upper surface of layer 1 comprise one electrode and the metallic substrate 2 coupled to a reference potential, such as ground, comprises a second electrode. Alternatively, substrate 2 may be omitted and layer 1 may be supplied with the reference potential. The positive electrostatic charges deposited on the upper surface of layer 1 induce mirror charges, indicated as negative electric charges, at the upper surface of the metallic substrate 2. The insulating characteristics of the 3d metal oxide prevent any migration of the opposite charges; and the positive electrostatic charges are stored on the upper surface of layer 1. It should be appreciated that the stored electrostatic charges admit of a slow discharge rate which is a function of the high intrinsic time constant of the capacitor. The actual time constant thereof, and of course the corresponding discharge rate is dependent upon the particular 3d metal oxide selected. A higher time constant is obtained if the 3d metal oxide is dispersed in a resin binder, as aforesaid. The 3d metal oxide resin film displays a preferably low discharge rate. It is expected that if certain portions of the 3d metal oxide undergo an insulator-to-metal transition, those electrostatic charges deposited upon such portions will be conducted through the 3d metal oxide toward the negative electric charges and, similarly, the mirror charges will be conducted through the 3d metal oxide toward the positive electric charges. Hence, the layer 1 will be correspondingly discharged.

The temperature at the surface of the 3d metal oxide layer 1 may be increased by projecting radiant energy of a sufficient wavelength thereon. The transmitted radiant energy may be in the form of electromagnetic waves such as visible or invisible light. When the electromagnetic waves impinge upon the surface of the 3d metal oxide layer 1, their energy is converted to heat resulting in an increase in the ambient temperature. It should be recognized that if the 3d metal oxide layer 1 has been previously disposed in an ambient temperature that is just below the Neel temperature, the resulting heat derived from the impinging radiant energy may be sufficient to increase the temperature at the surface of the metal oxide layer to exceed the Neel temperature such that the 3d metal oxide layer undergoes an insulator-to-metal transition. FIG. 1B illustrates that the temperature of certain portions of the 3d metal oxide layer 1 may be selectively increased in accordance with a determined character pattern by modulating the projected radiant energy. Accordingly, a character pattern 5 is interposed between a source of radiant energy 6 and the 3d metal oxide layer 1. The character pattern 5 may comprise conventional film means bearing images of information prerecorded thereon. The source of radiant energy 6 may comprise a conventional light emissive element capable of emitting visible light and infra red light upon being suitably energized. It is appreciated that the character pattern 5 is comprised of light and dark portions adapted to modulate the radiant energy transmitted therethrough such that radiant energy admitting of a maximum amplitude is transmitted through the light portions of the character pattern 5 and radiant energy admitting of a minimum amplitude is transmitted through the dark portions of the character pattern. It is observed that those portions of the 3d metal oxide layer 1 upon which the light areas of the character pattern are imaged experience an increase in temperature. This increase, which is a function of the spectrum of the radiant energy emitted by the source of radiant energy 6 and the duration of exposure to said radiant energy, should exceed the Neel temperature whereby said portions undergo an insulator-to-metal transition. It is understood therefore that, in accordance with the assumed example wherein the 3d metal oxide is $VO_2$, the temperature at the surface of that portion of layer 1 upon which the light area of the character pattern 5 is imaged, is increased to exceed 68°C. At the same time, however, those portions of the 3d metal oxide layer 1 upon which the dark areas of the character pattern 5 are imaged retain the electrical characteristics of an insulator. Those portions of the 3d metal oxide that have undergone the insulator-to-metal transition now exhibit high electrical conductivity, characteristic of an electrically conductive metal. Hence, the electrostatic charge deposited on the surface of such portions are discharged through the 3d metal oxide layer 1 whereas the electrostatic charge overlying those remaining portions of the 3d metal oxide layer that have not undergone an insulator-to-metal transition are retained. Accordingly, the selective increase in temperature above the Neel temperature of the 3d metal oxide layer 1 results in a correspondingly selective dissipation of the layer of electrostatic charge to form an electrostatic latent image of the impinging radiant energy. FIG. 1B illustrates the discharge of that portion of the 3d metal oxide layer 1 that is in juxtaposition to the light area of the character pattern 5.

It is here noted that the temperature of certain portions of the 3d metal oxide layer 1 may be increased to exceed the Neel temperature, and therefore, those portions of the 3d metal oxide layer may be forced to undergo an insulator-to-metal transition, by impinging radiant energy that has been reflected thereto. Accordingly, character pattern 5 is not limited to the configuration of film means wherein radiant energy is transmitted therethrough. It is contemplated that the character pattern 5 may comprise a document having graphic information recorded thereon such that radiant energy transmitted thereto is modulated and reflected by the character pattern 5 to the 3d metal oxide layer 1. Hence, the light image projected onto the 3d metal oxide layer may be a reflected image.

A further embodiment of the present invention is proposed wherein the temperature of certain portions of the 3d metal oxide layer 1 is selectively increased in accordance with a determined pattern of thermal energy. Accordingly, a stylus comprised of an array of selectively activatable thermal elements may be positioned in proximity to the 3d metal oxide layer. A character pattern comprised of thermal energy may be produced by selectively activating the thermal elements of the stylus. The close proximity of the stylus to the 3d metal oxide layer 1 enables the ready transfer of thermal energy to the surface of the 3d metal oxide whereby the temperature of corresponding portions thereof is increased. The layer of electrostatic charge is thus selectively dissipated in the manner described hereinabove.

The electrostatic latent image formed by the selectively dissipated electrostatic charge may now be developed to form a viewable image of the original character pattern. The manner in which the electrostatic latent image may be developed may comprise any well known technique heretofore utilized in the electrophotographic art wherein an electroscopic material, capable of adhering to the electrostatic charge pattern on the surface of the 3d metal oxide layer 1, is applied thereto. The nature and composition of the electroscopic material, which may include solid or liquid toner, is well known in the art as is the manner in which an electrostatic latent image is treated with such material. A more complete description thereof may be found in U.S. Pat. No. 2,885,955 issued to R. G. Vyverberg and assigned to Xerox Corporation, the assignee of the present invention, and in U.S. Pat. No. 3,084,043 issued to R. W. Gundlach and assigned to Xerox Corporation. These developing techniques may include magnetic brush developing well known to those skilled in the xerographic developing art. It is noted that, if desired, the developing process may reverse the polarity of the electrostatic latent image so that the image may be directly developed to form a print corresponding to a photographic reversal of the original exposure. Such means are well known and described in U.S. Pat. No. 2,817,765 issued to R. E. Hayford et al.

FIG. 1C illustrates that the electroscopic material 7 is provided with an electric charge opposite in polarity to the electrostatic charge remaining on the surface of the 3d metal oxide layer 1. Accordingly, in the assumed example, the charge of the electroscopic material 7 may be negative. Accordingly, the electrostatic attraction between the positive electrostatic charges and the negatively charged electroscopic material results in an adherence of the electroscopic material to those charged portions of the 3d metal oxide layer 1. It is observed that those portions on the surface of the 3d metal oxide layer corresponding to the dark areas of the character pattern 5 are supplied with electroscopic material. Thus, if the character pattern 5 corresponds to a photographic positive, the developing technique illustrated in FIG. 1C results in a photographically positive viewable image. However, if the character pattern 5 corresponds to a photographic negative, the developing technique illustrated herein results in a photographically negative viewable image. To achieve positive development of the electrostatic latent image, the polarity of the charge born by the electroscopic material 7 should be opposite to the polarity of the electrostatic charge pattern disposed across the surface of the 3d metal oxide layer 1. Hence, if the electrostatic charges admit of a negative polarity, the electroscopic material 7 admits of a positive polarity.

The developed viewable image may be transferred to a support surface such as surface 8 illustrated in FIG. 1D. The surface 8 may comprise paper, glass, plastic, or any suitable material upon which it is desirable to record a viewable image. The developed image comprised of the electroscopic material 7 may be transferred to the print receiving surface 8 in a well known manner. A charging device, not shown, such as a conventional corona discharge device, may deposit a charge on the back of print receiving surface 8 which is of the same polarity as the electrostatic charge on the surface of the 3d metal oxide layer 1 and is thus opposite in polarity to the charge on the electroscopic material utilized in developing the electrostatic latent image. The charge on print receiving surface 3 results in the transfer of the electroscopic material from the 3d metal oxide layer 1 onto the print receiving surface in the well known manner. Alternatively, the print receiving surface 8 or the electroscopic material 7 may be coated with an adhesive substance. If the surface 8 is placed in overlying relation with respect to the 3d metal oxide layer 1 such that the surface contacts the electroscopic material 7, the adhesive coating will cause the electroscopic particles 9 to adhere to the surface 8. The electroscopic particles thus transferred to the surface result in a final copy of the original character pattern. The electroscopic material transferred to the print receiving surface 8 by either electrostatic or adhesive transfer may be fixed, such as by conventional heat or solvent fixing, whereby the electroscopic material is fused to the surface 8.

After the developed viewable image is transferred to a suitable support surface, the 3d metal oxide layer 1 may be made ready for reuse by removing residual electroscopic particles from the surface thereof and by discharging the electrostatic charge comprising the electrostatic latent image on the surface of the 3d metal oxide layer. FIG. 1E illustrates that the removal of the residual electroscopic particles from the surface of the layer 1 may be effected by suitable cleaning means such as a rotating brush 10 or the like. Alternatively, granular material may be utilized to clean the surface of the 3d metal oxide layer by cascading the granular material across the layer 1 wherein the electroscopic particles are attracted to the granular material by triboelectric action. In addition, the electroscopic material may be removed from the surface of the 3d metal oxide layer 1 by well known solvent cleaning techniques. A further technique that may be adopted to remove the residual electroscopic material from the surface of the 3d metal oxide layer 1 may be similar to that described in U.S. Pat. Application Ser. No. 180,426 filed on Sept. 14, 1971, by John T. Bickmore, now U.S. Pat. No. 3,818,864 wherein a suitably biased electrode is employed. The electrostatic charge pattern remaining on the surface of the 3d metal oxide layer 1 may be discharged by increasing the ambient temperature to a value above the Neel temperature. When the ambient temperature is thus increased, the entire 3d metal oxide layer will undergo an insulator-to-metal transition wherein the layer will exhibit the electrical characteristics of an electrically conductive metal. Hence, the electrostatic charges will migrate through the 3d metal oxide layer thereby returning the surface of said layer to a neutral charge. The 3d metal oxide layer is now ready to be reused in the aforedescribed manner. It should be noted, however, that most 3d metal oxides contemplated for use in the electrothermographic reproducing technique that has been disclosed herein exhibit thermal hysteresis. Consequently, the ambient temperature must be reduced below the Neel temperature to force the 3d metal oxide to undergo a metal-to-insulator transition.

Another embodiment that is contemplated for developing the electrostatic latent image is illustrated in FIG. 2. In this embodiment, electroscopic material 11 is applied to the surface of the 3d metal oxide layer 1 in a manner identical to that described hereinabove with reference to FIG. 1C. In this embodiment however, the electroscopic material 11 exhibits a polarity equal to that of the electrostatic charge pattern distributed across the surface of the 3d metal oxide layer 1. Accordingly, if the electrostatic charges deposited by corona discharge device 3 admit of a positive polarity, the electroscopic material 11 likewise admits of a positive polarity. Conversely, if the electrostatic charges deposited by the corona discharge device admit of a negative polarity, electroscopic material 11 similarly admits of a negative polarity. Consequently, an electrostatic repelling force is exerted upon the electroscopic material 11 by the electrostatic charge pattern. Hence, the electroscopic particles 11 are deposited on the surface of the 3d metal oxide layer 1 in such areas that are substantially free of electrostatic charge. Thus, it is seen that those regions of the electrostatic latent image that correspond to the light areas of the original character pattern 5 will have electroscopic material 11 deposited thereon, whereas those regions of the electrostatic latent image that correspond to the dark areas of the character pattern 5 will have no electroscopic material deposited thereon. Accordingly, the development illustratively represented in FIG. 2 corresponds to a photographic negative developing process such that the viewable image is phographically reversed. Hence, if character pattern 5 corresponds to a photographic negative, the developed viewable image is a photographically positive image. Conversely, if the character pattern 5 comprises an original document to be reproduced, i.e., a photographic positive, the reversing developing process illustrated herein results in a photographically negative viewable image. The viewable image thus formed by the selectively deposited electroscopic material 11 may be transferred to a suitable support surface in a manner analogous to that previously described with reference to FIG. 1D.

It should be understood that although the step of depositing a layer of electrostatic charge on the surface of the 3d metal oxide layer 1 and the step of imaging a character pattern onto the surface of layer 1 have been described as individual steps, these steps may be performed substantially simultaneously. Furthermore, these steps may, if desired, be executed in inverse order. Consequently, the imaging of a character pattern comprised of modulated radiant energy onto the surface of the 3d metal oxide layer 1 disposed in an ambient temperature below the Neel temperature will force certain portions of layer 1 to undergo an insulator to-metal transition such that said certain portions exhibit high electrical conductivity. If electrostatic charges are deposited upon the surface of the 3d metal oxide layer 1 in the presence of the imaged radiant energy, it is appreciated that the electrostatic charges will be retained by those portions that have not undergone the insulator-to-metal transition whereas the electrostatic charges deposited on the certain portions that now exhibit high electrical conductivity will migrate through said certain portions, through the metallic substrate 2 to ground. Accordingly, an electrostatic latent image of the modulated radiant energy will be formed.

Although the present invention has been specifically described with reference to one particular 3d metal oxide, viz., $VO_2$, it is of course recognized that layer 1 may be comprised of an oxide of any suitable 3d transition metal including titanium, vanadium, chromium, manganese, iron, cobalt, nickel and copper. Furthermore, sulfides of such metals are also contemplated for layer 1. Nevertheless it should be noted that the ambient temperature within which the layer 1 is disposed should be just below the transition temperature therefor. The 3d metal oxide $VO_2$ has been preferably described hereinabove because of the convenient transition temperature exhibited thereby.

The specific structure that may be utilized in carrying out the novel process of the present invention is not essential for a sufficient understanding thereof. However, the 3d metal oxide layer 1 may be formed into a drum configuration, an endless belt configuration or the like. Moreover, the 3d metal oxide layer overlying the metallic substrate 2 may be disposed in a suitable vessel for accurate control of the ambient temperature. Thus, while the invention has been particularly shown and described in reference to specific embodiments thereof it will be obvious to those skilled in the art that the foregoing and various other changes and modifications in form and details may be made without departing from the spirit and scope of the invention. It is therefore intended that the appended claims be interpreted as including all such changes and modifications.

What is claimed is:

1. A method of producing viewable images on a surface comprised of an oxide of a 3d transition metal, comprising the steps of:

establishing an ambient temperature of said surface below the insulator-to-metal transition temperature of said 3d transition metal oxide such that said 3d transition metal oxide exhibits low electrical conductivity;

depositing a uniform layer of electrostatic charge on said surface;

selectively increasing the temperature of certain portions of said surface above said insulator-to-metal transition temperature in accordance with a determined pattern such that said certain portions exhibit high electrical conductivity whereby said uniform layer of electrostatic charge is selectively dissipated to form an electrostatic latent image of said determined pattern; and developing said electrostatic latent image to form a viewable image of said determined pattern.

2. The method of claim 1 wherein said step of selectively increasing the temperature of certain portions of said 3d transition metal oxide comprises transferring thermal energy in a character pattern to said surface.

3. The method of claim 1 wherein said step of developing said electrostatic latent image comprises the step of applying electroscopic particles to said surface.

4. The method of claim 3 wherein said step of developing said electrostatic latent image comprises the additional step of transferring said developed electrostatic image to a support surface to form a copy of a viewable image of said determined pattern.

5. A method of producing viewable images comprising the steps of:

depositing a layer of electrostatic charge on the surface of a 3d metal oxide, said surface being at an ambient temperature below the insulator-to-metal transition temperature thereof and exhibiting the electrical characteristics of an insulator;

causing certain portions of said surface to undergo a transition such that said certain portions exhibit the electrical characteristics of an electrically conductive metal by increasing the temperature of said certain portions to exceed said insulator-to-metal transition temperature whereby said layer of electrostatic charge is selectively dissipated to form an electrostatic latent image; and developing said electrostatic latent image to form a viewable image thereof.

6. The method of claim 5 wherein said step of causing certain portions of said surface to undergo a transition comprises transferring thermal energy in a character pattern to said surface.

7. The method of claim 6 wherein said step of developing comprises the steps of;

applying electroscopic particles to said surface to form a viewable image; and transferring said viewable image to a support surface to form a copy of a viewable image of said character pattern.

8. A method of producing viewable images comprising the steps of:

selectively modulating the temperature of the surface of a 3d metal oxide relative to the insulator-to-metal transition temperature thereof that certain portions are below and certain other portions above said transition temperature in an image configuration, depositing an electrostatic charge on said surface of said 3d metal oxide whereby said electrostatic charge is selectively retained on the portions of said surface below said transition temperature to form an electrostatic latent image; and developing said electrostatic latent image to form a viewable image thereof.

9. The method of claim 8, wherein said step of selectively modulating the temperature of the surface of said 3d metal oxide comprises transferring thermal energy to said surface, said surface being disposed in an ambient temperature lower than said insulator-to-metal transition temperature.

10. The method of claim 8, wherein said step of selectively modulating the temperature of the surface of said 3d metal oxide comprises the steps of:

transferring thermal energy to said surface; and decreasing the ambient temperature below said insulator-to-metal transition temperature whereby the temperature of portions of said surface to which said thermal energy is transferred exceeds said insulator-to-metal transition temperature and the temperature of the remaining portions of said surface is less than said insulator-to-metal transition temperature.

11. A method of producing viewable images comprising the steps of:

depositing a layer of electrostatic charge on the surface of a 3d transition metal compound selected from the group consisting of a 3d transition metal oxide and a 3d transition metal sulfide, said surface being disposed in an ambient temperature lower than the insulator-to-metal transition temperature of said compound;

selectively increasing the the temperature of certain portions of said surface to exceed said insulator-to-metal transition temperature to correspondingly dissipate said electrostatic charge thereby forming an electrostatic latent image; and developing said electrostatic latent image to form a viewable image.

12. The method of claim 11 wherein the 3d transition metal compound comprises $VO_2$ and wherein said step of developing said electrostatic latent image comprises the step of applying electroscopic particles to said surface to form a viewable image of said electrostatic latent image.

13. The method of claim 11 wherein the 3d transition metal compound comprises CrS and wherein said step of developing said electrostatic latent image comprises the step of applying electroscopic particles to said surface to form a viewable image of said electrostatic latent image.

* * * * *